United States Patent [19]

Brown et al.

[11] 4,132,250

[45] Jan. 2, 1979

[54] WIRE TWISTING SYSTEM

[75] Inventors: William T. Brown, North Andover; Robert J. Moran, Littleton; Larry M. LeBlanc, Nabnasset, all of Mass.

[73] Assignee: Alphatron Incorporated, North Andover, Mass.

[21] Appl. No.: 810,085

[22] Filed: Jun. 27, 1977

[51] Int. Cl.[2] ..... B21F 7/00

[52] U.S. Cl. ..... 140/115; 140/149

[58] Field of Search ..... 140/115, 149

[56] References Cited

U.S. PATENT DOCUMENTS

| | | | |
|---|---|---|---|
| 2,217,301 | 10/1940 | Wennberg | 140/149 |
| 2,234,641 | 3/1941 | Baumgartner | 140/149 |
| 3,957,092 | 5/1976 | Loy et al. | 140/115 |

*Primary Examiner*—Lowell A. Larson

*Attorney, Agent, or Firm*—Morse, Altman, Oates & Bello

[57] ABSTRACT

A system is disclosed for use in twisting together two or more wires precisely to a predetermined number of turns. The apparatus includes a pair of spaced chucks adapted to grip opposite ends of the wires which are placed therebetween for twisting. A manually operated switch causes the chuck jaws to close through a pneumatic control at the start of the twisting operation once the wires are in position. At the end of the twisting operation the jaws open automatically and the twisted wires are dropped. One of the chucks is fixed against rotation but is adapted to slide axially to a limited extent controlled by means of a coil spring in order to accommodate for the shortening of the wires as they are twisted. The other chuck is fixed against axial motion but rotatably mounted and driven by a motor adapted to rotate for a precise number of turns. A counting circuit controls the motor and includes means for twisting wires beyond the preset number of turns and then reversing the turns in order to remove any tendency for the twisted wires to unwind.

8 Claims, 11 Drawing Figures

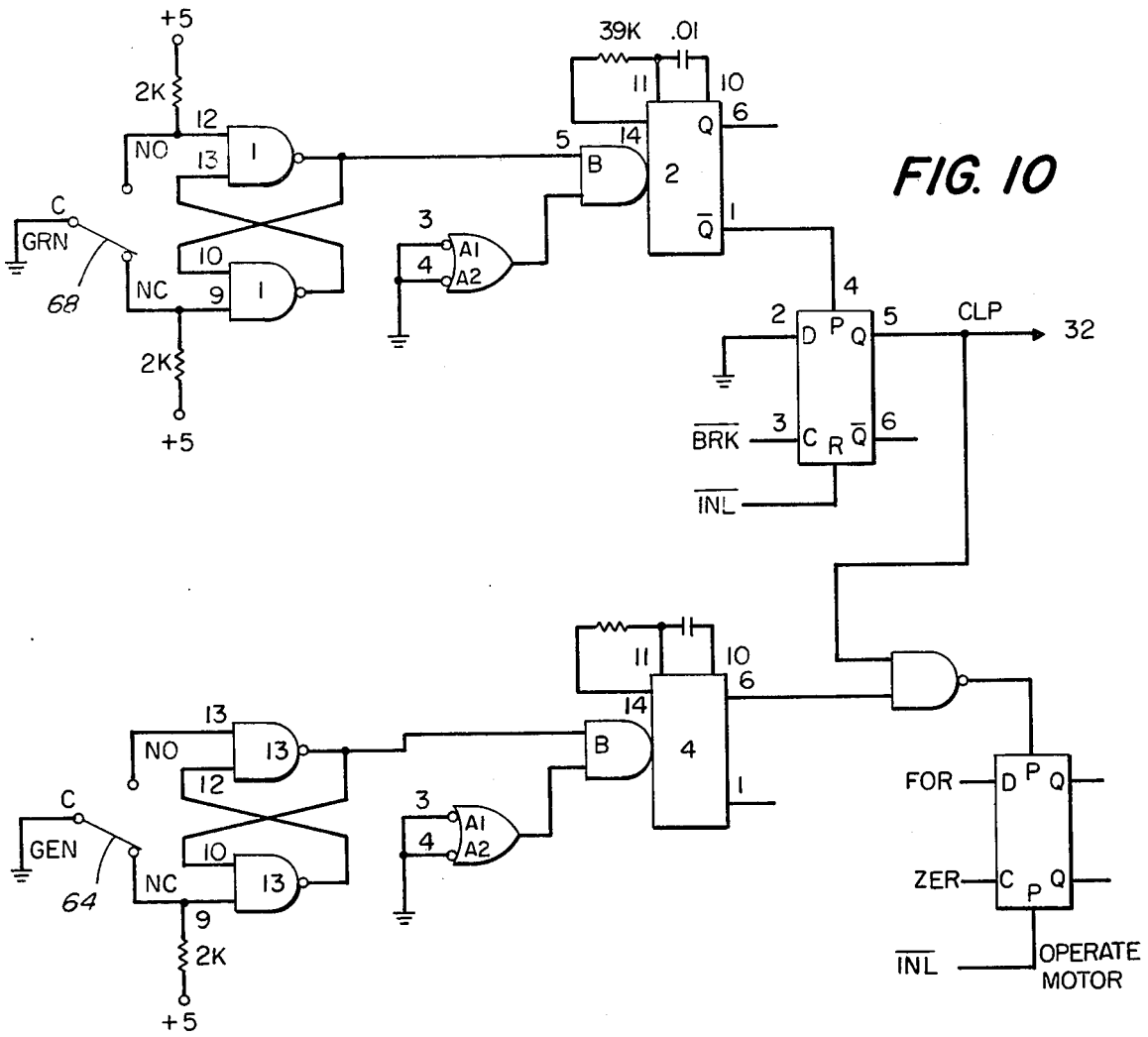
FIG. 10
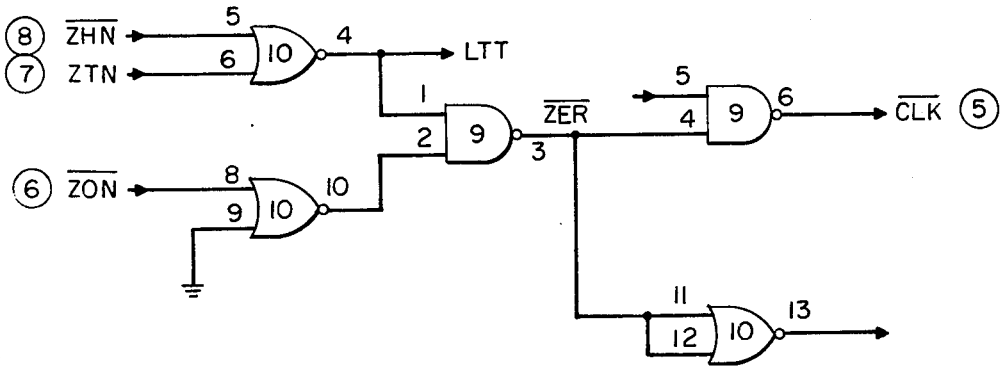

WIRE TWISTING SYSTEM

BACKGROUND OF THE INVENTION

1. Field of the Invention

This invention relates generally to wire twisting equipment and more particularly is directed towards a new and improved system for twisting together two or more wires for a precise, predetermined number of turns in such a way as to remove any tendency of the wires to unwind.

2. Description of the Prior Art

For a number of reasons it is desirable to twist together wires used in many different types of electronic products. Wires twisted together in bundles not only are less cluttering, but also eliminate electronic noise which may develop from untwisted wires and affect other parts of a system. Thus, many manufacturers of electronic equipment will specify that various connecting wires be twisted in the finished product. While some equipment has been available for twisting wires, such equipment generally has been relatively rudimentary and inefficient. Generally, the number of turns applied to sets of wires is optimal for a particular combination and length of wire, as well as for the direction of turn. Also, equipment currently available merely twists the wires in one direction and the finished twisted bundle often tends to unwind, often resulting in damage to the wire ends which usually are stripped.

Accordingly, it is an object of the present invention to provide a new and improved system for twisting together two or more wires for a predetermined number of turns in such a manner as to remove any tendency of the wires to unwind. Another object of the invention is to provide a wire twisting system which is simple and easy to operate in order to allow greater productivity, as well as to provide flexibility both in direction and number of turns applied to wires.

SUMMARY OF THE INVENTION

This invention features a system for twisting together two or more wires, comprising a pair of spaced chucks adapted to grip opposite ends of the wires placed therebetween, manually-actuated means for closing the chuck jaws and starting a twisting cycle, automatic means for opening the jaws at the end of the cycle, a motor for rotating the jaws, counting circuits which may be preset to a particular number of turns for controlling the motor, and reversing means connected to the counting circuits which first twists the wires beyond the desired number and then reverse twists back to the desired number in order to remove any unwinding tendency in the wires. The chucks are mounted for movement to and away from one another to accommodate wires of different lengths. Switching means are provided for reversing the primary direction of wire twisting, as desired.

BRIEF DESCRIPTION OF THE DRAWINGS

FIGS. 10 and 11 are circuit diagrams showing logic circuits providing various control functions.

DETAILED DESCRIPTION OF THE PREFERRED EMBODIMENT

Figure 1:
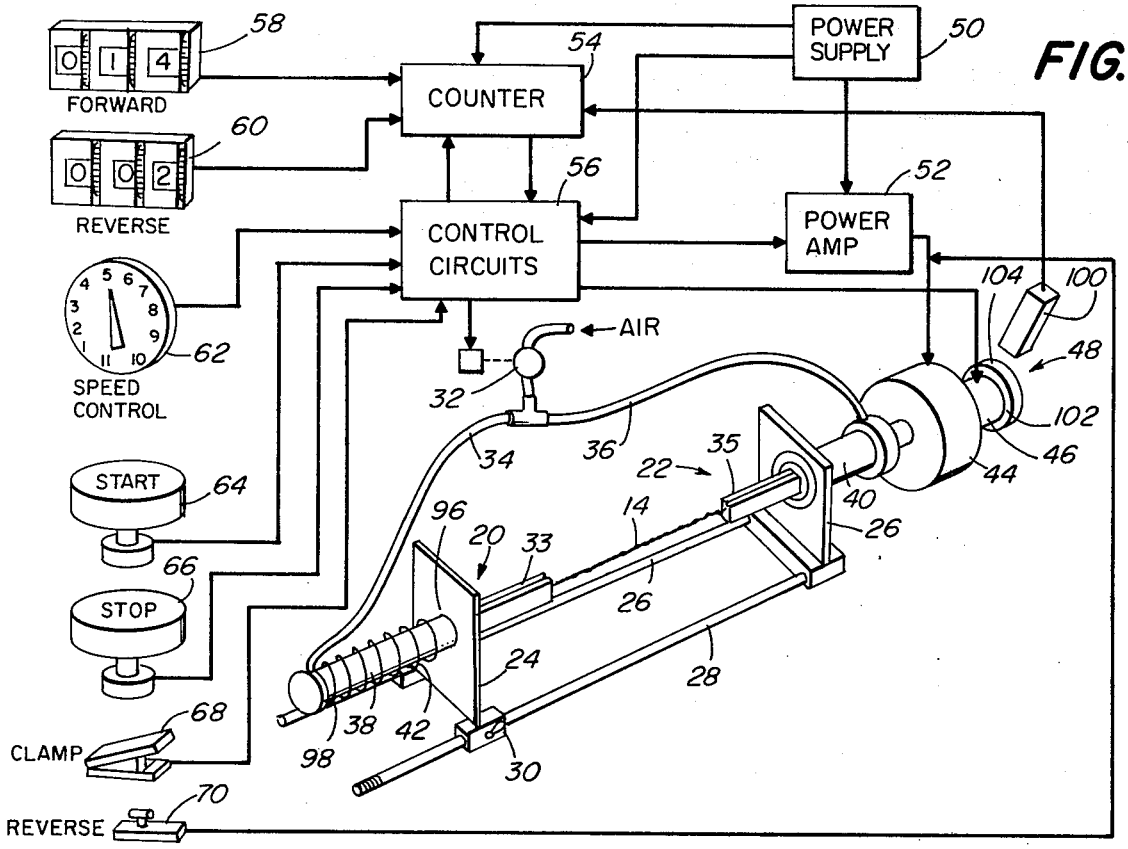
FIG. 1 is a view in perspective, somewhat schematic, of a wire-twisting system made according to the invention.
Figure 2:
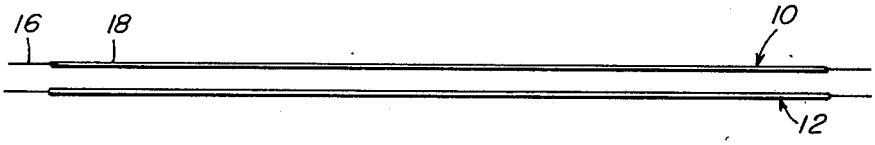
FIG. 2 is a view in side elevation showing a pair of wires to be twisted together.
Figure 3:
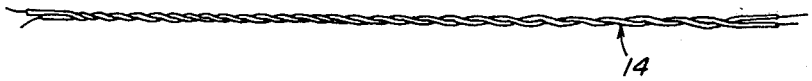
FIG. 3 is a view in side elevation showing the FIG. 2 wires twisted together.

Referring now to the drawings, and to FIGS. 1, 2 and 3 in particular, there is illustrated a system for use in twisting together two or more wires 10 and 12 into a twisted bundle 14. Typically the wires 10 and 12 include a core of conductive wire in a strand 16 covered by a flexible dielectric plastic sheathing 18, usually color coded, and an insulating helical wrapping in some instances is provided between the wire 16 and the sheath 18. In practice, the wires 10 and 12 are cut to a predetermined length depending upon the specifications required in the end product in which the wires are to be used. Normally, the ends of the wires are stripped to expose the conductive strands 16 prior to their being twisted together to avoid subsequent unwinding or loosening of the wires after twisting. As may be seen by comparing FIGS. 2 and 3, the overall length of the two wires twisted together is somewhat shorter than the wires prior to twisting, the shortening effect being due to the twisting.

The wires 10 and 12 are twisted together by gripping opposite ends of the wires in spaced chucks in a tailstock 20 and a headstock 22 and rotating the headstock 22 for a predetermined number of turns, while the opposite end is held against rotation. The wires are then removed in the form of the twisted pair shown in FIG. 3.

The system shown in FIG. 1 is comprised of the tailstock 20 and headstock 22, each including an upright bracket 24 and 26, with the chuck jaws axially aligned with one another in opposite facing relation. Both brackets 24 and 26 are connected to a pair of rods 26 and 28 forming a guideway with the bracket 26 being fixed at one end while the bracket 24 may be moved back and forth along the guideway in order to change the distance between the headstock and tailstock. In this fashion the system may accommodate the wide variety of wires in different lengths by merely moving the tailstock closer to or further from the headstock. A screw clamp 30, or other locking device, may be provided in order to lock the tailstock at any selected position along the guideway, which may be marked with appropriate graduations for measurement purposes.

Figure 4:
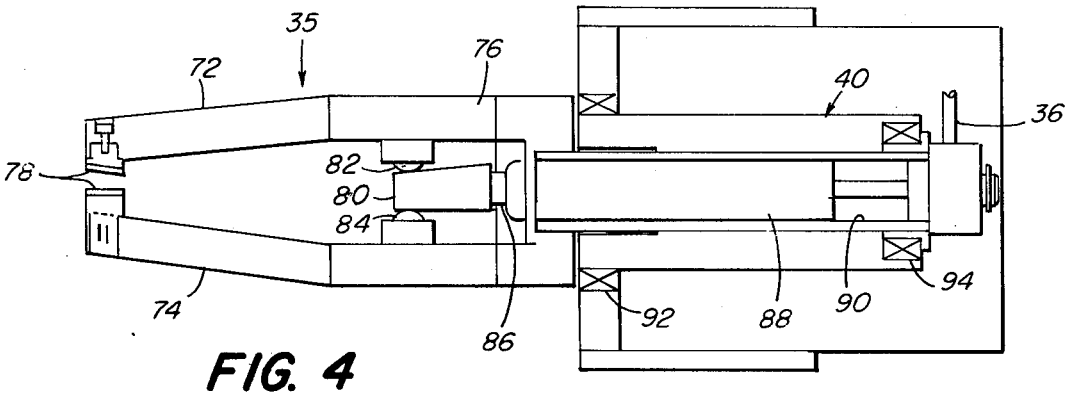
FIG. 4 is a top plan view of the headstock assembly used in the FIG. 1 system.
Figure 5:
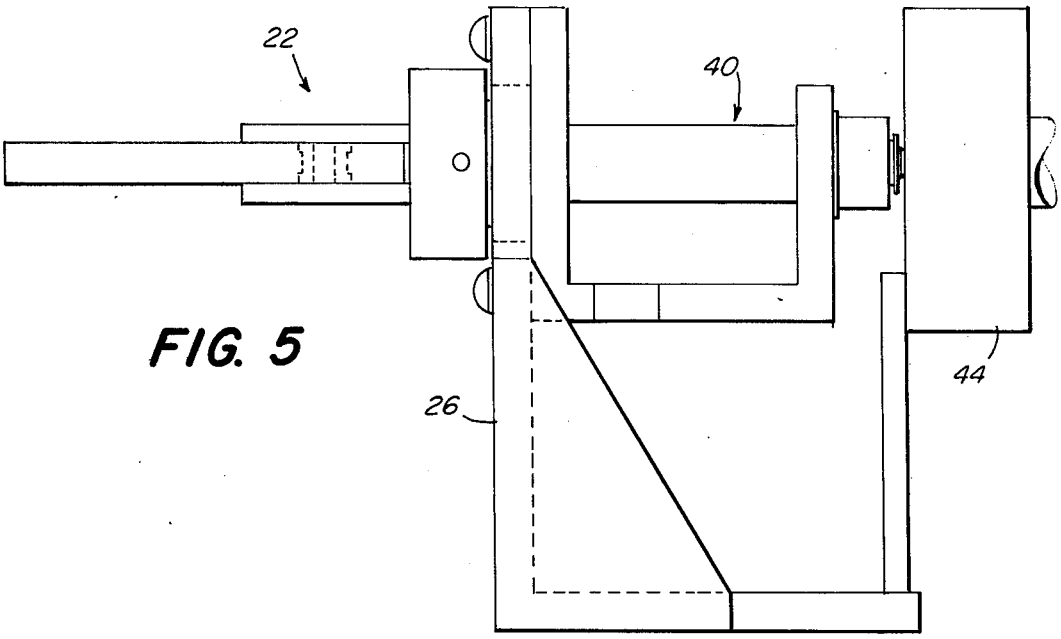
FIG. 5 is a view in side elevation thereof.

In the illustrated embodiment the tailstock 20 and headstock 22 are pneumatically actuated to open and close the jaws of their chucks 33 and 35 at the same time under the control of a pneumatic solenoid-actuated valve 32. The valve 32 is connected to a source of compressed air, and by means of tubing 34 and 36 provides compressed air to pneumatic actuators 38 and 40 operatively connected to the chucks 33 and 35. Details on the construction of the chucks and the actuators are shown in FIGS. 4 and 5 and will be described more fully below.

The tailstock chuck 33 is mounted for limited axial movement but is not free to rotate. A constant force coil spring 42 is mounted about the actuator 38, between the bracket 24 and the end of the actuator, and serves to apply the constant force against the wires 14 as they are twisted by the rotating headstock chuck 35. The actuator 38 and chuck 33 thus move gradually along the axis towards the chuck 35 as the wires are twisted and shortened. The chuck 35 is rotated by means of a reversible low inertia DC motor 44 to which is connected a brake 46 and an electro-optical unit 48 used to count the number of rotations of the motor and to stop the chuck and motor at the same angular position after each cycle.

The motor 44 and brake 46 are driven and controlled by a number of functional components, including a power supply 50 energizing a power amplifier 52 for the motor 44, a counter 54, and control circuits 56. The counter 54 receives inputs from the electro-optical unit 48 and from a pair of digital switches 58 and 60, the switch 58 being used to dial in the desired number of turns in the forward direction, while the switch 60 is employed to dial in the desired number of turns in the reverse direction. The photoelectric unit provides counting pulses to the counter as a feedback loop to correlate the number of turns of the motor with the number of turns set in by the switches 58 and 60. Connected to the control circuit 56 is a speed control device 62 which essentially is a potentiometer and serves to control the rotational speed of the motor 44. Also included are start and stop switches 64 and 66 in position to be operated by hand, and a foot-operated clamp switch 68 which is used to close the jaws of the chucks 20 and 22. A reversing switch 70 is also provided and connects to the motor to allow the motor to be rotated in either direction, depending upon the direction of the twist to be imparted to the wires.

The system is operated by first setting the distance between the headstock and the tailstock according to the length of the wires to be twisted. Next, the operator dials in the required number of turns, in both the forward and the rearward directions, on the digital switches 58 and 60. The operator then sets the speed control 62 at the rate desired and places the two or more wires to be twisted together between the chucks so that opposite ends are gripped by the jaws of the chucks 33 and 35. Once in position, the operator depresses the foot-operated clamp switch 68, which causes the jaws to close, gripping the wires. The twisting cycle is then started by manually depressing the start button 64, which will cause the motor 44 to turn the chuck 35, twisting together the wires. The motor will turn in the primary twisting direction for the predetermined number of turns, plus an additional number of turns, at which point it will stop and reverse for a preset number of turns so that the exact number of turns are made in the wires. For example, in the system, as set up in FIG. 2, the wires will be twisted in the forward direction fourteen turns and then reversed two turns so that a net of twelve turns will be made in the wires. At the end of the cycle, the motor will be stopped by the brake after the precise number of turns and at the same angular position as at the start. The jaws of the two chucks will open automatically through the pneumatic actuators and the twisted wire bundle will drop. In the event of any malfunctions, the cycle may be stopped at any time by depressing the stop switch 66, and the direction of twisting may be changed by actuating the reverse switch 70.

Referring now more particularly to FIGS. 4 and 5, the construction and operation of the headstock 22 will be described. The headstock is supported by the bracket 26 and includes the motor 44, the actuator 40, and the chuck 35. The chuck is comprised of a pair of jaws 72 and 74 formed by means of a U-shaped member 76 mounted to the end of the actuator 40. The outer ends of the jaws 72 and 74 are provided with replaceable resilient pads 78 of sponge rubber, or the like, and are mounted oppositely one another for gripping the ends of the wires placed therebetween. The jaws 72 and 74 normally are closed and are of a rigid yet somewhat resilient material, by means of which the jaws will spring back to a closed position after being forced open. The jaws are opened by means of a wedge 80 driven between a pair of rollers 82 and 84, one mounted on the inner face of each jaw 72 and 74, as best shown in FIG. 4. The wedge 80 is mounted on the end of a rod 86 drivingly connected to a piston 88 mounted for reciprocation within a cylinder 90 of the actuator 40. When air is applied under pressure through the conduit 36, the piston 88 is driven to the left, as viewed in FIG. 4, thereby driving the wedge 80 to the left between the rollers 82 and 84, forcing them apart to thereby open the pads 78 at the end of the jaws and allow the wires to be placed therebetween. On the start of a cycle, the piston retracts and the wedge is withdrawn to allow the jaws to spring shut, thereby clamping the wires.

The chuck 34, together with the actuator 40, are rotatable about their longitudinal axes and are mounted in suitable bearings 92 and 94 to the bracket 26.

The tailstock 20 includes a chuck 33 and a pneumatic actuator 38 similar to those in the headstock, and the trailstock chuck is adapted to open and close simultaneously with the chuck of the headstock. The primary difference between the headstock and the tailstock is that the actuator 38 and its chuck 33 are not free to rotate but are free to slide axially with respect to the bracket 24, and for this purpose a suitable bearing 96 is provided. In order to provide a uniform pull through the entire cycle, the spring 42 is selected so as to have linear characteristics. However, the force level of the spring is adjustable as by means of a take-up nut 98 mounted on the actuator. By presetting the nut, the force level of the spring may be adapted according to the character of the wires being twisted. Once the force level has been set, it will remain constant throughout the twisting cycle.

Figure 6:
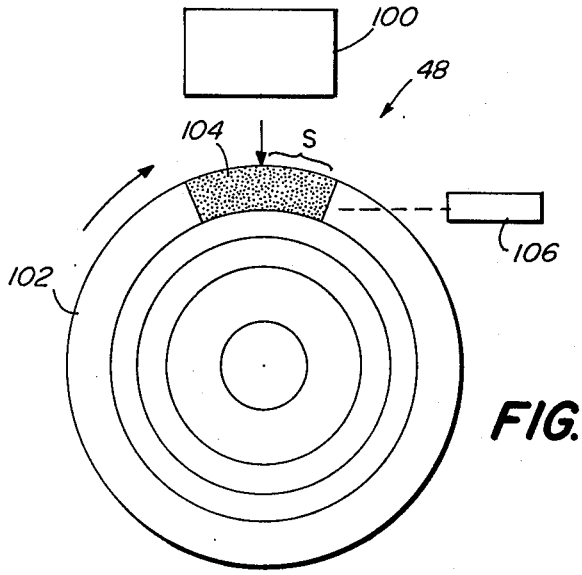
FIG. 6 is a detailed view of the photo-electric sensor and shaft coding arrangement.
Figure 7:
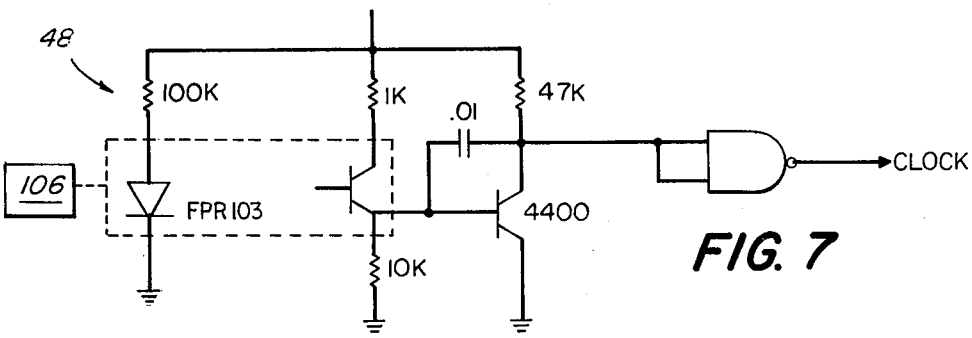
FIG. 7 is a circuit diagram of the clock and generator used in controlling the system.

Referring now to FIGS. 6 and 7, there are illustrated details of the electro-optical feedback controller for monitoring the number of turns of the motor and for initiating the braking action at the appropriate angular position. This part of the system includes a photo-electric pickup 100 which is positioned in close proximity to an annular face 102, which is connected to and rotates at the same speed as the motor 44. The annular face 102 is divided into two arcuate segments, the larger of which is of a highly reflective character and typicaly presents a white surface. A smaller arcuate segment 104 is of a nonreflective character and typically is coated black. The black area 104, in practice, has an arcuate length two times the stopping distance of the motor. In FIG. 6, the letter "S" represents an arc corresponding to the stopping distance, which is one-half the length of the black area 104. The black arc 104 and the white arc of the face 102 define two transitional lines on either side of the black arc. One transition occurs from white to black and the other from black to white as the shaft rotates. The transition lines generate pulses when the face 102 is illuminated as by a light-emitting diode 106 and detected by means of photoelectric pickup 100. The pulses are generated by the rotating shaft and are processed through the circuit shown in FIG. 7 and fed into the counter 54 for correlation with the preset numbers set into the digital switches 58 and 60.

Figure 9:
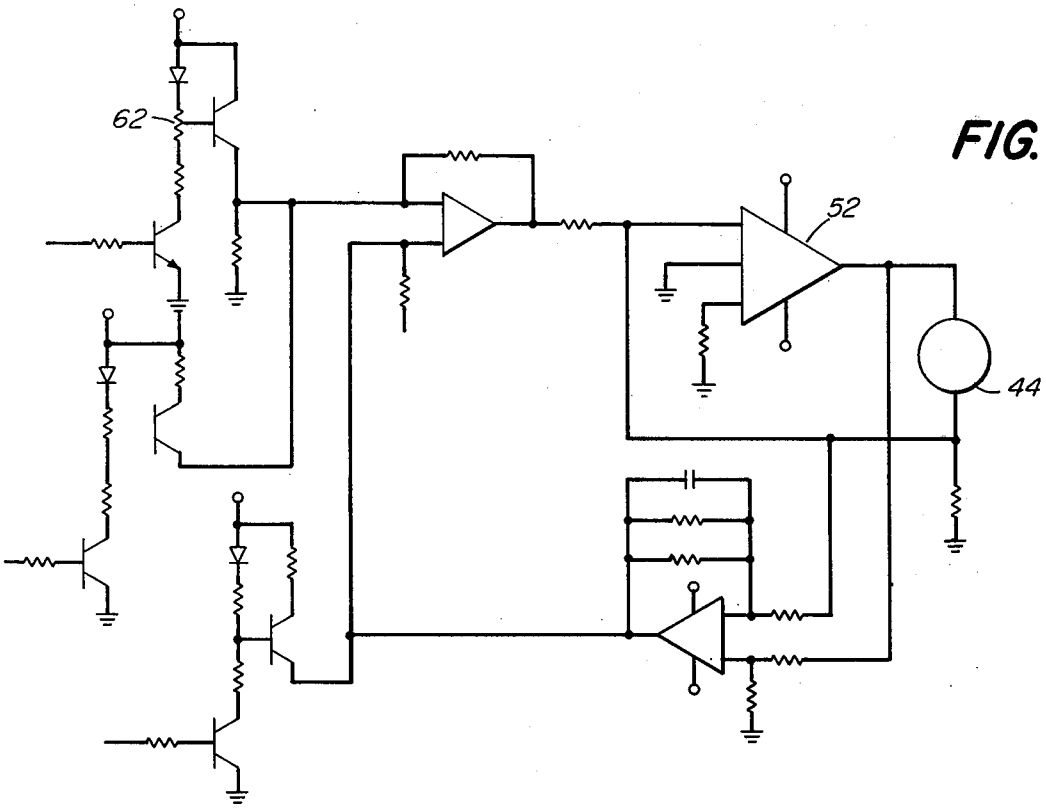
FIG. 9 is a diagram of the analog circuits.
Figure 8:
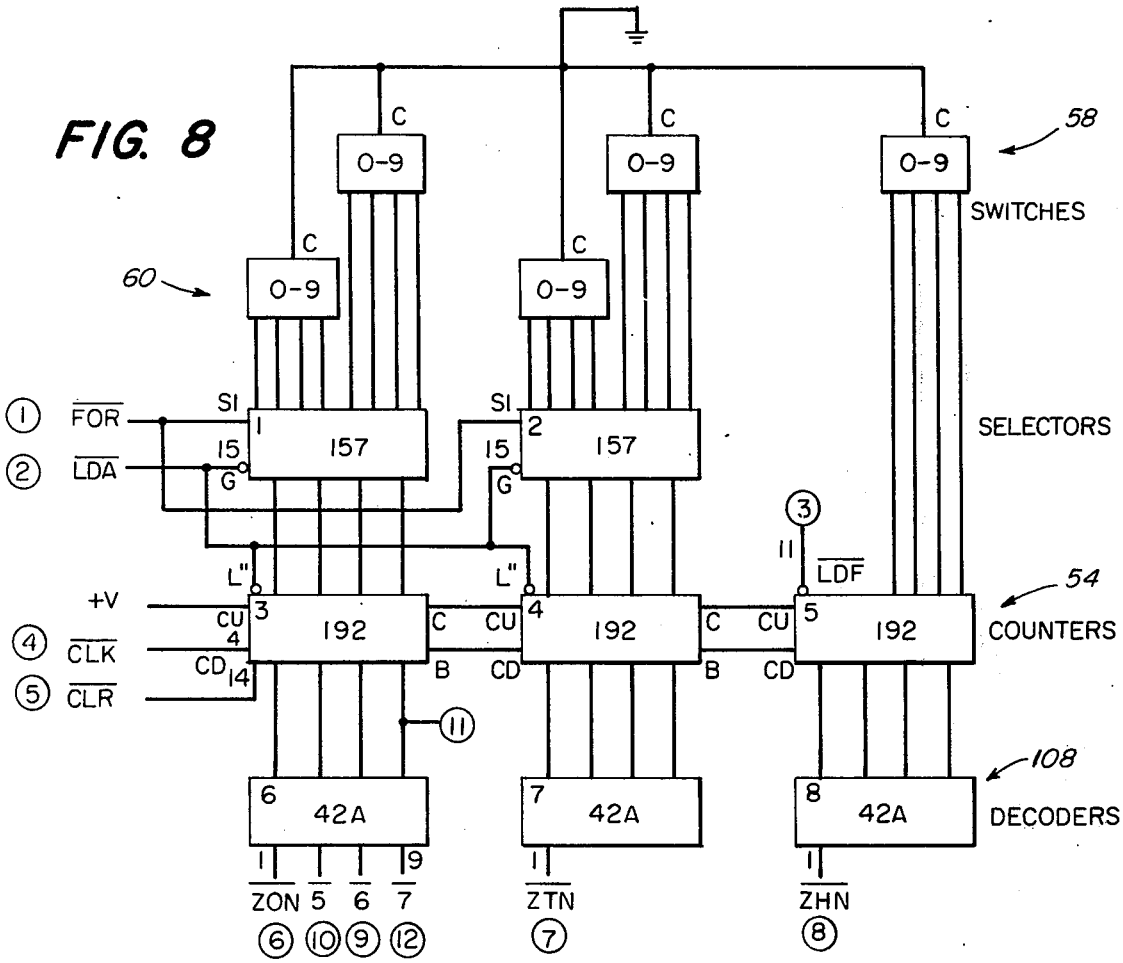
FIG. 8 is a circuit diagram of the counter circuits.
Figure 11:
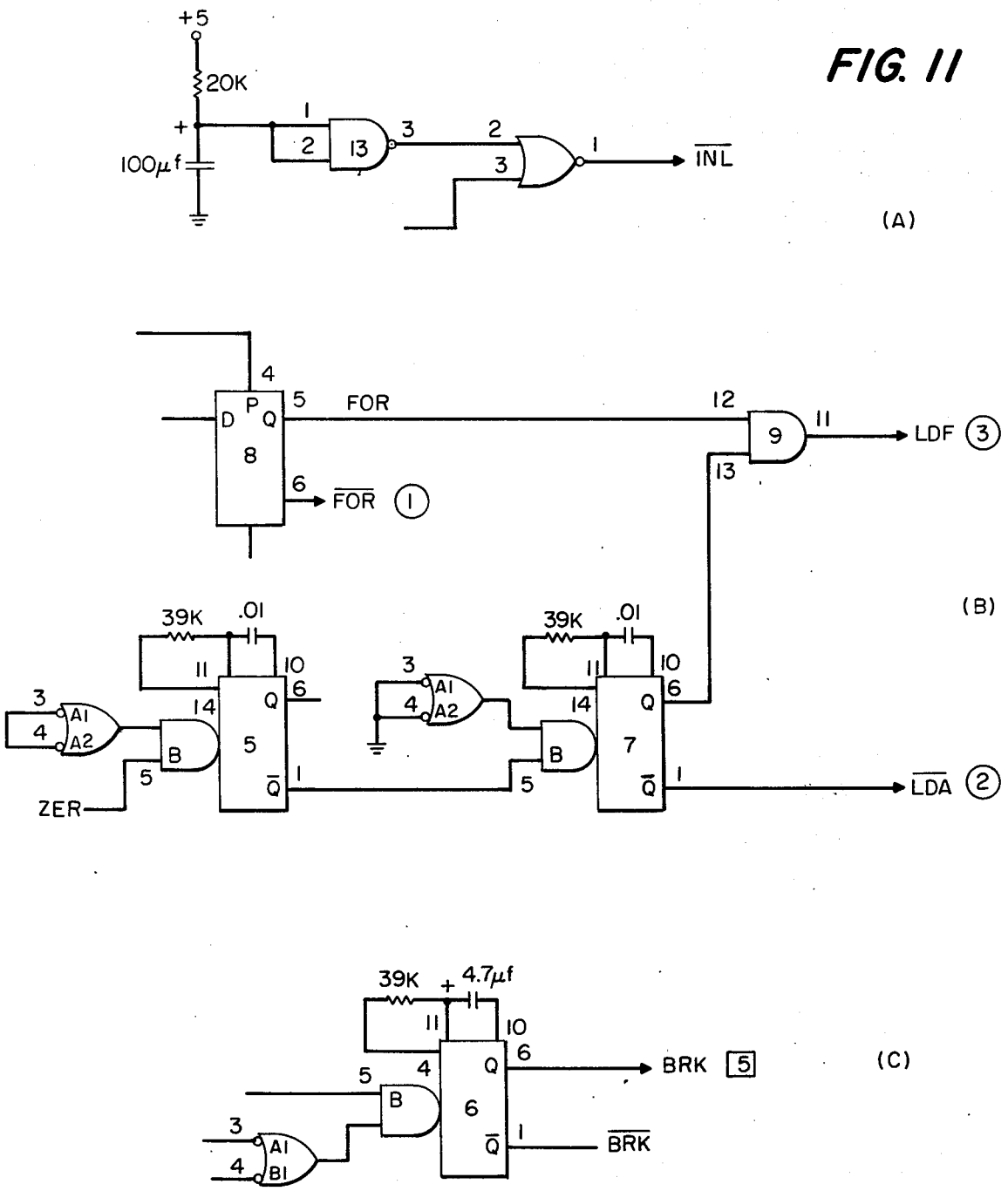

In FIG. 8, there is shown a diagram of the counter circuitry which includes the forward switches 58 and the reverse switches 60 providing inputs into the counters 54. The counters also receive clocking pulses from the photoelectric pickup 100, as previously described. At the start of the cycle the counts on the switches 58 and 60 are dumped into the registers with the clocking pulses starting to count down. The count is continuously monitored by decoders 108, and the output of the decoders will control the velocity of the motor. The decoders control a bank of switches which, in turn, control the voltage to the motor terminal. This servo-control is more fully illustrated in the analog circuitry of FIG. 9. In operation, the system functions as follows: As long as a predetermined number of counts remains in the counters, the servosystem is connected to the manual control potentiometer 62 so that the running speed of the motor is as set by the operator. However, when the count is down to a preset number, typically four, then the counter puts out a signal causing the motor to slow down as it approaches the last few turns. When the count reaches zero, the motor, thus, is always at the same speed irrespective of the manual setting on the potentiometer. At the zero count the plateau level is removed and replaced by a negative value. At this point the counts in the reverse switches 60 are dumped into the register and the count is then counted down to zero by the clock pulses from the photo-electric pickup. When the reverse count reaches zero, the mechanical brake 46 is actuated with the logic circuitry controlling the brake, as illustrated in FIG. 11(*c*).

The motor employed preferably is formed with a flat armature, and the speed of the motor is proportional to the terminal voltage, thus, the speed control is a function of voltage control. The motor control is servosystem, with speed sensing on the motor being determined by the black EMF developed by the motor. Basically, the speed control unit is a potentiometer in which the potentiometer value is compared to the terminal voltage in a velocity-control servosystem. In the reversal mode the motor functions at a constant speed which is slow insofar as only a few number of turns normally are involved in the reverse twisting procedure.

The motor is characterized by low inertia and is easily stopped quickly by means of an electromagentic-actuated friction brake 46.

In FIG. 10, at the upper portion, there is illustrated the logic diagram for the pneumatic foot-actuated switch 68 for initially closing the chucks, while the center portion of FIG. 10 shows the circuitry for the starting switch 64.

Having thus described the invention, what we claim and desire to obtain by Letters Patent of the United States is:

1. Apparatus for twisting together two or more wires of substantially equal length, comprising (a) a pair of spaced axially aligned and oppositely facing chucks (b) one of said chucks being mounted for rotation about its axis, (c) the other of said chucks being fixed against rotation, (d) actuating means connected to said chucks for closing and opening said chucks whereby the ends of wires placed in said chucks may be gripped and released, (e) driving means connected to said one chuck for driving rotation thereof, and, (f) numerically adjustable control means connected to said driving means for rotating said one chuck in one direction for a pre-selected number of turns and then in a reverse direction for a pre-selected number of turns, (g) at least one of said chucks being mounted for limited axial movement to compensate for the shortening of wires as they are twisted, (h) spring means operatively connected to said axially moveable chuck to provide a counterforce thereto, (i) braking means connected to said one chuck for stopping said one chuck at the end of a twisting cycle, (j) said control means including manually adjustable forward and reverse digital switches, counting means connected to said switches, and rotation detecting means connected to said counting means and responsive to rotation of said one chuck for correlating the number of turns of said chuck with the numbers on said switches.

2. Apparatus, according to claim 1, wherein said spring means is characterized by a constant spring rate over its operating range.

3. Apparatus, according to claim 1, wherein each of said chucks includes a pair of jaws and each of said actuators includes a moveable wedge engaging said jaws for opening and closing thereof.

4. Apparatus, according to claim 1, including bracket means supporting said chucks, said brackets being mounted for relative movement to and away from one another for selectively adjusting the distance between said chucks.

5. Apparatus, according to claim 1, including speed control means connected to said driving means for selectively controlling the rotational speed of said one chuck.

6. Apparatus, according to claim 1, including reversing means connected to said driving means for altering the direction of rotation thereof.

7. Apparatus, according to claim 1, wherein said detecting means includes a light source, a photo-detecting unit in the path of said light source, and rotating light altering means connected to said one chuck and disposed in the path of said light source and said unit, said light altering means including an annular rotating surface having reflective and non-reflective arcuate segments, and said nonreflective segment having an arcuate length corresponding to twice the stopping distance of said chuck.

8. Apparatus, according to claim 3, wherein said actuators comrise pneumatically operated cylinders each including a piston drivingly connected to said wedge.

* * * * *